US008336519B2

(12) United States Patent
Lee

(10) Patent No.: US 8,336,519 B2
(45) Date of Patent: Dec. 25, 2012

(54) INTAKE SYSTEM OF ENGINE

(75) Inventor: Yong Cheol Lee, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 316 days.

(21) Appl. No.: 12/815,134

(22) Filed: Jun. 14, 2010

(65) Prior Publication Data

US 2011/0132312 A1 Jun. 9, 2011

(30) Foreign Application Priority Data

Dec. 3, 2009 (KR) ..... 10-2009-0119360

(51) Int. Cl.
*F02B 31/00* (2006.01)

(52) U.S. Cl. ..... 123/306; 123/336; 123/337

(58) Field of Classification Search ..... 123/188.16, 123/306, 336, 337, 184.53, 184.56, 188.1, 123/188.14, 188.4
See application file for complete search history.

(56) References Cited

U.S. PATENT DOCUMENTS

| | | | | |
|---|---|---|---|---|
| 3,299,869 | A * | 1/1967 | Sicklesteel | 123/90.27 |
| 4,817,374 | A * | 4/1989 | Kitta | 60/313 |
| 4,907,547 | A * | 3/1990 | Daly | 123/184.53 |
| 4,922,864 | A * | 5/1990 | Maeda | 123/184.28 |
| 6,581,567 | B2 * | 6/2003 | Deguchi | 123/336 |
| 7,284,532 | B2 * | 10/2007 | Ludmann et al. | 123/306 |
| 7,334,565 | B2 * | 2/2008 | Hanasato | 123/336 |
| 7,343,896 | B2 * | 3/2008 | Grant et al. | 123/336 |
| 7,543,563 | B2 * | 6/2009 | Dunn | 123/399 |
| 7,721,705 | B2 * | 5/2010 | Sato et al. | 123/336 |
| 8,042,514 | B2 * | 10/2011 | Arnold et al. | 123/336 |
| 8,042,521 | B2 * | 10/2011 | Yamada | 123/468 |
| 8,047,179 | B2 * | 11/2011 | Yamada | 123/336 |
| 8,074,628 | B2 * | 12/2011 | Albert et al. | 123/543 |
| 2009/0007884 | A1 * | 1/2009 | Bunne et al. | 123/399 |

FOREIGN PATENT DOCUMENTS

| | | | |
|---|---|---|---|
| JP | 6-4031 | Y2 | 2/1994 |
| KR | 2003-0067857 | A | 8/2003 |

* cited by examiner

*Primary Examiner* — Nathaniel Wiehe
*Assistant Examiner* — Grant Moubry
(74) *Attorney, Agent, or Firm* — Morgan, Lewis & Bockius LLP

(57) ABSTRACT

An intake system of an engine, may include first and second intake passages that are collaterally disposed to the engine, first and second shafts that are collaterally disposed along the first and second intake passages respectively, first flaps and second flaps that are mounted on the first shaft and the second shaft so as to open or close the first intake passages and the second intake passages respectively, an inter-lever, of which one end portion is pivotally and eccentrically connected to the first shaft and the other end portion is pivotally and eccentrically connected to the second shaft, and through which a rotation of the first shaft is transferred to the second shaft, and a driving portion connected to the first shaft and rotating the first shaft to have the first flaps and the second flaps open or close the first intake passages and the second intake passages respectively.

12 Claims, 6 Drawing Sheets

INTAKE SYSTEM OF ENGINE

CROSS-REFERENCE TO RELATED APPLICATION

This application claims priority to and the benefit of Korean Patent Application No. 10-2009-0119360 filed in the Korean Intellectual Property Office on Dec. 3, 2009, the entire contents of which are incorporated herein by reference.

BACKGROUND OF THE INVENTION

1. Field of the Invention

The present invention relates to an intake system of an engine. More particularly, the present invention relates to an intake system of an engine that is disposed at an intake passage to form a tumbling flow of air or air-fuel mixture.

2. Description of Related Art

Generally, there is a method of forming tumble in intake air so as to enhance combustion of an engine.

A flap valve is disposed at an intake passage so as to generate tumble, and a technique of adjusting the opening rate of the flap is being applied.

Speed of intake air is increased, pressure thereof is decreased, fuel amount that is attached on a wall of an intake port is reduced, and the fuel is effectively vaporized by forming the tumble.

Accordingly, the fuel is uniformly mixed, such that a lean combustion is enabled, quality of exhaust gas is improved, the combustion is effectively performed, and the temperature of the exhaust gas purification catalyst is quickly raised. Thus, the purification efficiency of the exhaust gas purification catalyst is also improved.

In a structure having a first bank and a second bank such as a V6 engine, research has being been undertaken to efficiently control the opening rate of the flap disposed at the intake passage of respective banks, and it is necessary that the durability thereof is good, interference between components is low, structure is simple, and assembly is easy.

The above information disclosed in this Background section is only for enhancement of understanding of the background of the invention and therefore it may contain information that does not form the prior art that is already known in this country to a person of ordinary skill in the art.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an intake system of an engine having advantages of which component interference is reduced, durability is enhanced, and assembly becomes easier.

In an aspect of the present invention, the intake system of an engine, may include first intake passages and second intake passages that are collaterally disposed to the engine, a first shaft and a second shaft that are collaterally disposed along the first intake passages and the second intake passages respectively, first flaps and second flaps that are mounted on the first shaft and the second shaft so as to open or close the first intake passages and the second intake passages respectively, an inter-lever, of which one end portion is pivotally and eccentrically connected to the first shaft and the other end portion is pivotally and eccentrically connected to the second shaft, and through which a rotation of the first shaft is transferred to the second shaft, and a driving portion connected to the first shaft and rotating the first shaft to have the first flaps and the second flaps open or close the first intake passages and the second intake passages respectively.

The driving portion may include a first connecting lever, one end portion of which is connected to one end portion of the first shaft, and the other end portion of which extends in a radial direction of the first shaft, an outer lever, one end portion of which is pivotally connected to the other end portion of the connecting lever, a second connecting lever, one end portion of which is pivotally connected to the other end portion of the outer lever, and a motor coupled to the other end portion of the second connecting lever and moving the second connecting lever to rotate the first shaft in a predetermined angle.

The one end portion of the inter-lever may be pivotally and eccentrically connected to a portion of the first shaft between the first flaps and the other end portion of the inter-lever is pivotally and eccentrically connected to one of the second flaps.

A bracket may be coupled to the first shaft between the first flaps, a first protrusion is formed on the bracket, and a first ball joint is formed at one side surface of the first protrusion.

The first protrusion may be formed at an opposite side of the first flap across the first shaft and extends in a predetermined length in a radial direction of the first shaft.

The first ball joint may be formed to extend from the first protrusion along a longitudinal axis of the first shaft.

A first insertion hole, through which the first ball joint is inserted, may be formed at the one end portion of the inter-lever.

A second protrusion may be formed at the one of the second flaps in accordance with the first protrusion and a second ball joint is formed at one end portion of the second protrusion in accordance with the first ball joint.

The second flap may include a receiving cut portion to receive the other end portion of the inter lever therein.

The second protrusion may be formed at an opposite side of the second flap across the second shaft and extends in a predetermined length in a radial direction from the second shaft, wherein the second ball joint is formed to extend from the second protrusion along a longitudinal axis of the second shaft.

A second insertion hole, through which the second ball joint is inserted, may be formed at the other end portion of the inter-lever.

The second intake passages may be disposed at positions between the first intake passages such that the first intake passages and the second intake passages are alternately disposed.

As stated above, the inter-lever directly connects the middle portion of the first shaft and the second shaft neighboring each other, such that external interference is low and durability is high in the intake system of an engine according to the present invention.

Further, the inter-lever has a ball joint structure to be connected to the first shaft and the second shaft, such that the operating structure is simple and the assembly becomes easier.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
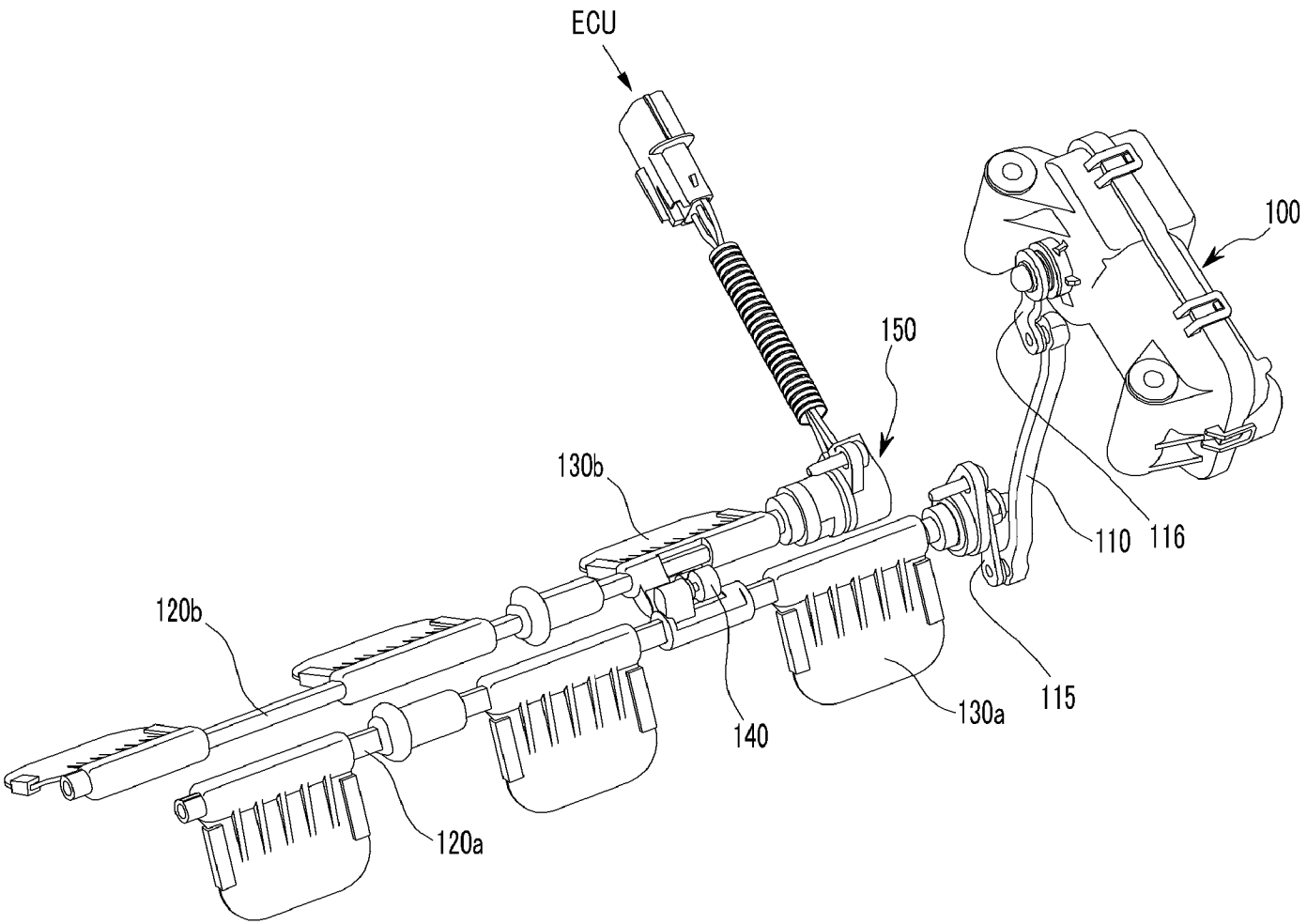
FIG. 1 is a perspective view of an exemplary intake system of an engine according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a perspective view of an intake system of an engine according to an exemplary embodiment of the present invention.

Referring to FIG. 1, an intake system of an engine includes a first shaft 120*a*, a second shaft 120*b*, a first flap 130*a*, a second flap 130*b*, an outer lever 110, an inter-lever 140, a driving portion 100, and a sensor 150.

The first shaft 120*a* and the second shaft 120*b* are disposed in parallel with each other, the first flaps 130*a* are disposed at the first shaft 120*a* with a predetermined distance therebetween, and the second flaps 130*b* are disposed at the second shaft 120*b* with a predetermined distance therebetween.

In an exemplary embodiment of the present invention, the second flaps 130*b* are disposed at a position between the first flaps 130*a*. That is, the first flaps 130*a* are alternately disposed with the second flaps 130*b*.

Figure 6:
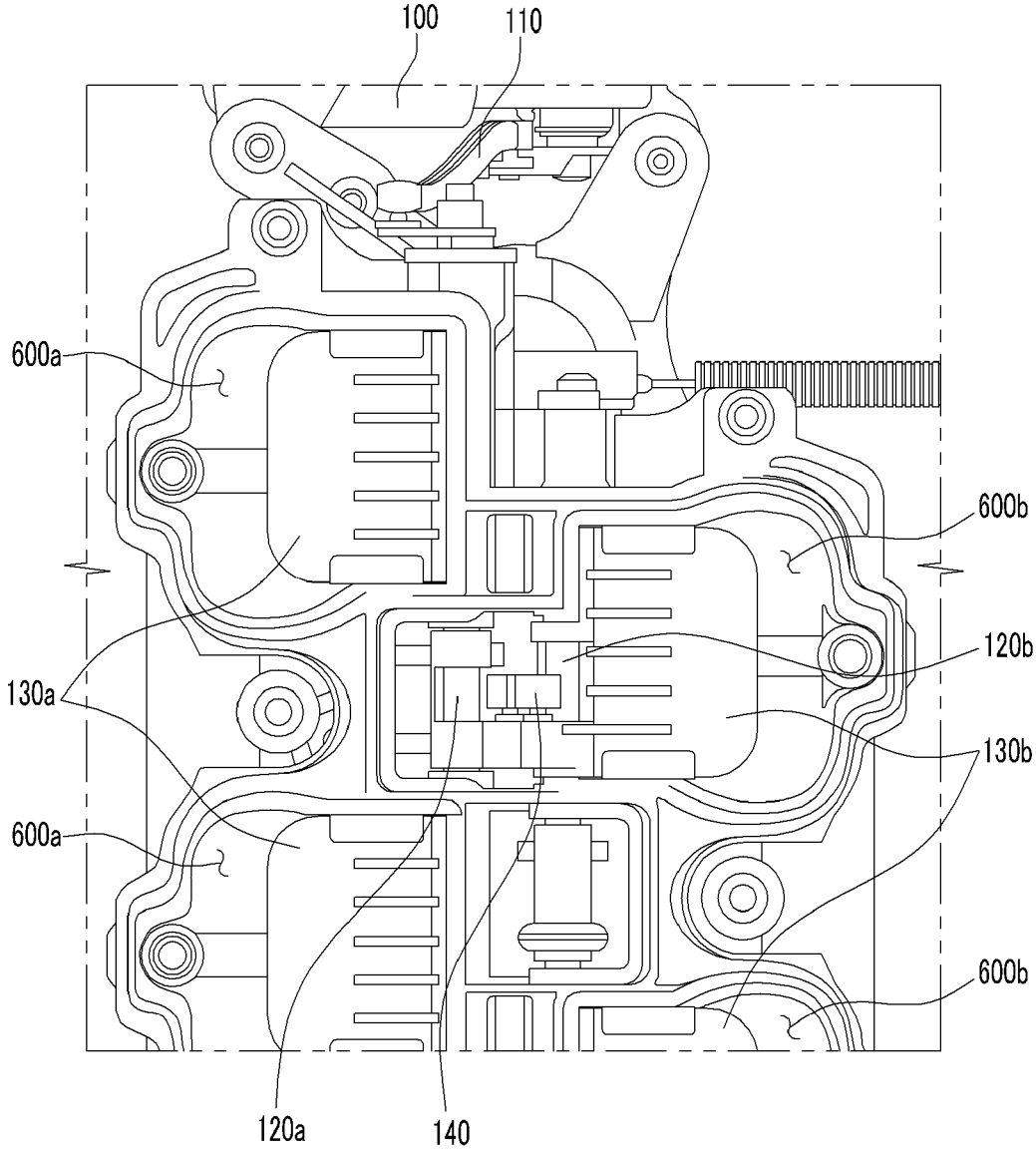
FIG. 6 is a top plan view showing a closed intake passage in an exemplary intake system of an engine according to the present invention.

Referring to FIG. 6, the first flaps 130*a* are respectively disposed at first intake passages 600*a* and the second flaps 130*b* are respectively disposed at second intake passages 600*b*. The first intake passages 600*a* and the second intake passages 600*b* are disposed in parallel with each other and are alternately disposed.

As stated above, the first shaft 120*a* and the second shaft 120*b* are disposed in parallel with each other and are disposed between the first intake passage 600*a* and the second intake passage 600*b*.

Referring to FIG. 1, a first connecting lever 115 is connected to one end portion of the first shaft 120*a* and the outer lever 110 is pivotally coupled to the first connecting lever 115. The driving portion 100 such as a motor is connected to the outer lever 110 by a second connecting lever 116.

The driving portion 100 pushes one end of the outer lever 110 by the second connecting lever 116 such that the other end of the outer lever 110 rotates the first shaft 120*a* via the first connecting lever 115.

Further, if the first shaft 120*a* rotates, the inter-lever 140 rotates the second shaft 120*b* by the same angle.

The sensor 150 is disposed at one end portion of the second shaft 120*b* and the sensor 150 transfers a rotation signal of the second shaft 120*b* to a control portion (ECU).

The control portion (ECU) detects rotation amount of the first shaft 120*a* and the second shaft 120*b* based on the rotation signal transferred from the sensor 150, uses the rotation amount to calculate opening rate of the first intake passage 600*a* and the second intake passage 600*b*, and controls the driving portion 100 depending on the opening rate.

One side of the inter-lever 140 is connected to the first shaft 120*a* between the first flaps 130*a*, and the other side of the inter-lever 140 is connected to the second flap 130*b*.

Figure 2:
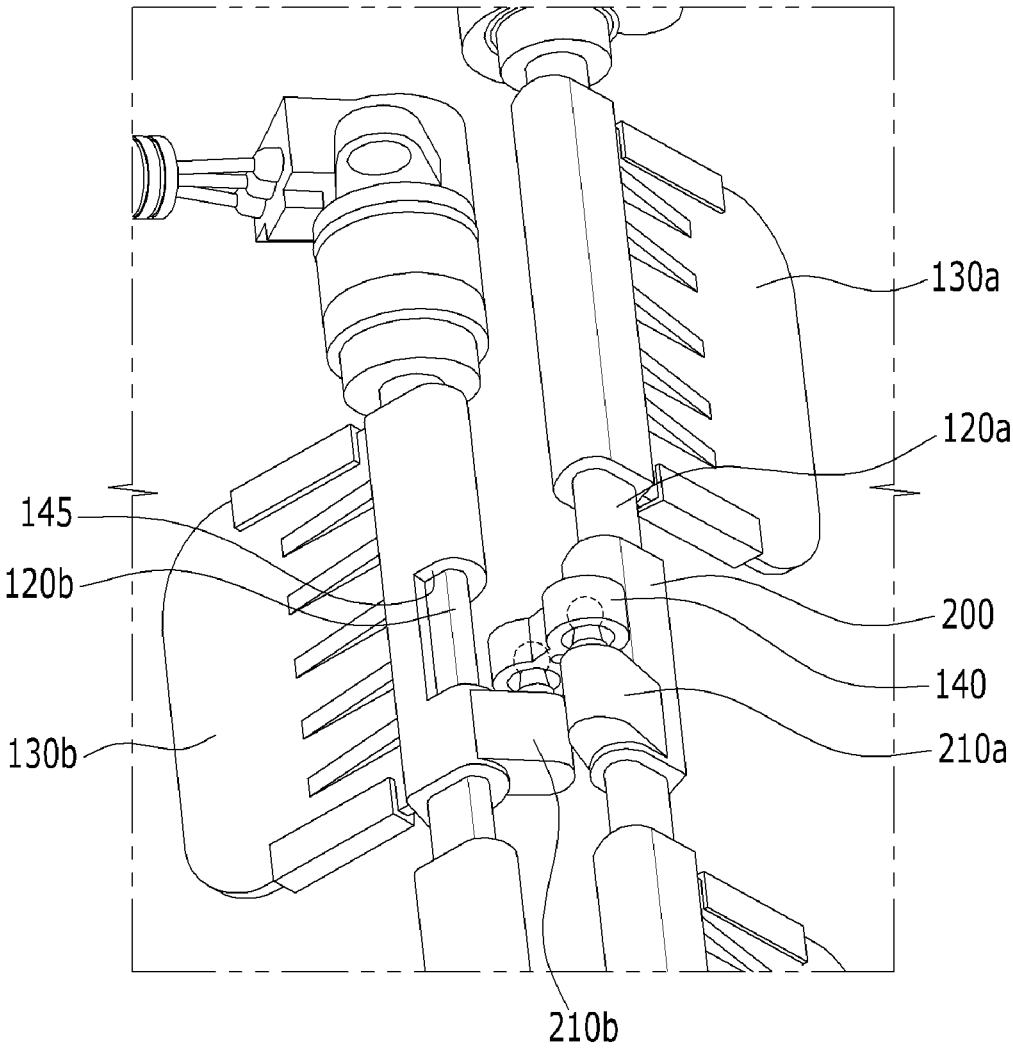
FIG. 2 is a partial perspective view of an exemplary intake system of an engine according to the present invention.

FIG. 2 is a partial perspective view of an intake system of an engine according to an exemplary embodiment of the present invention.

Referring to FIG. 2, a bracket 200 is mounted at the first shaft 120*a* between the first flaps 130*a*, and a first protrusion 210*a* is formed at the outer surface of the bracket 200.

Further, a second protrusion 210*b* is integrally formed with the second flap 130*b* corresponding to the first protrusion 210*a*, one side of the inter-lever 140 is connected to the first protrusion 210*a*, and the other side of the inter-lever 140 is connected to the second protrusion 210*b*.

As shown, the second protrusion 210*b* is integrally formed with the second flap 130*b* at the opposite side of the second flap 120*b* across the second shaft 120*b*.

Figure 3:
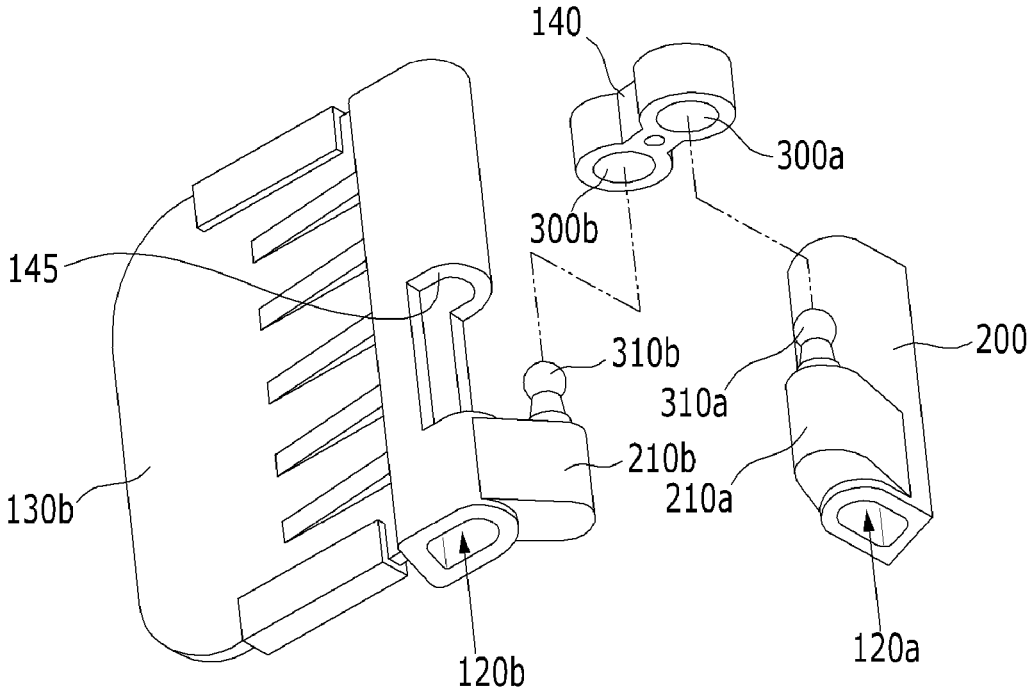
FIG. 3 is an exploded perspective view of an exemplary intake system of an engine according to the present invention.

FIG. 3 is an exploded perspective view of an intake system of an engine according to an exemplary embodiment of the present invention.

Referring to FIG. 3, a first ball joint 310*a* protrudes at a side surface of the first protrusion 210*a* formed on the bracket 200 mounted on the first shaft 120*a*, and a second ball joint 310*b* protrudes at a side surface of the second protrusion 210*b* integrally formed with the second flap 130*b* mounted on the second shaft 120*b*.

A first insertion hole 300*a* is formed at a surface of one side of the inter-lever 140, through which the first ball joint 310*a* is inserted, and a second insertion hole 300*b* is formed at a surface of the other side of the inter-lever 140, through which the second ball joint 310*b* is inserted.

The first ball joint 310*a* is inserted into the first insertion hole 300*a*, the second ball joint 310*b* is inserted into the second insertion hole 300*b*, and the inter-lever 140 connects the bracket 200 with the second flap 130*b*. Accordingly, the first shaft 120*a* and the bracket 200 rotate such that the inter-lever 140 rotates the second flap 130*b* and the second shaft 120*b*.

Since the inter-lever 140 is mounted through the first ball joint 310*a* and the second ball joint 310*b*, a flexible assembly structure is formed and assembly thereof becomes easier. However, when the joint 310*a* is not a ball but is square, the assembly thereof has to be precise. That is, the inter-lever 140 combines with the first and second ball joints 310*a* and 310*b* such that the inter-lever 140 can move or rotate in a predetermined range based on the center of the ball.

Further, the inter-lever 140 received in a receiving cut portion 145 formed in the second flap 130*b* is not exposed like the outer lever 110 and directly connects the first shaft 120*a* and the second shaft 120*b* neighboring each other, such that external interference is limited, trouble is low, and the durability thereof is high.

Figure 4:
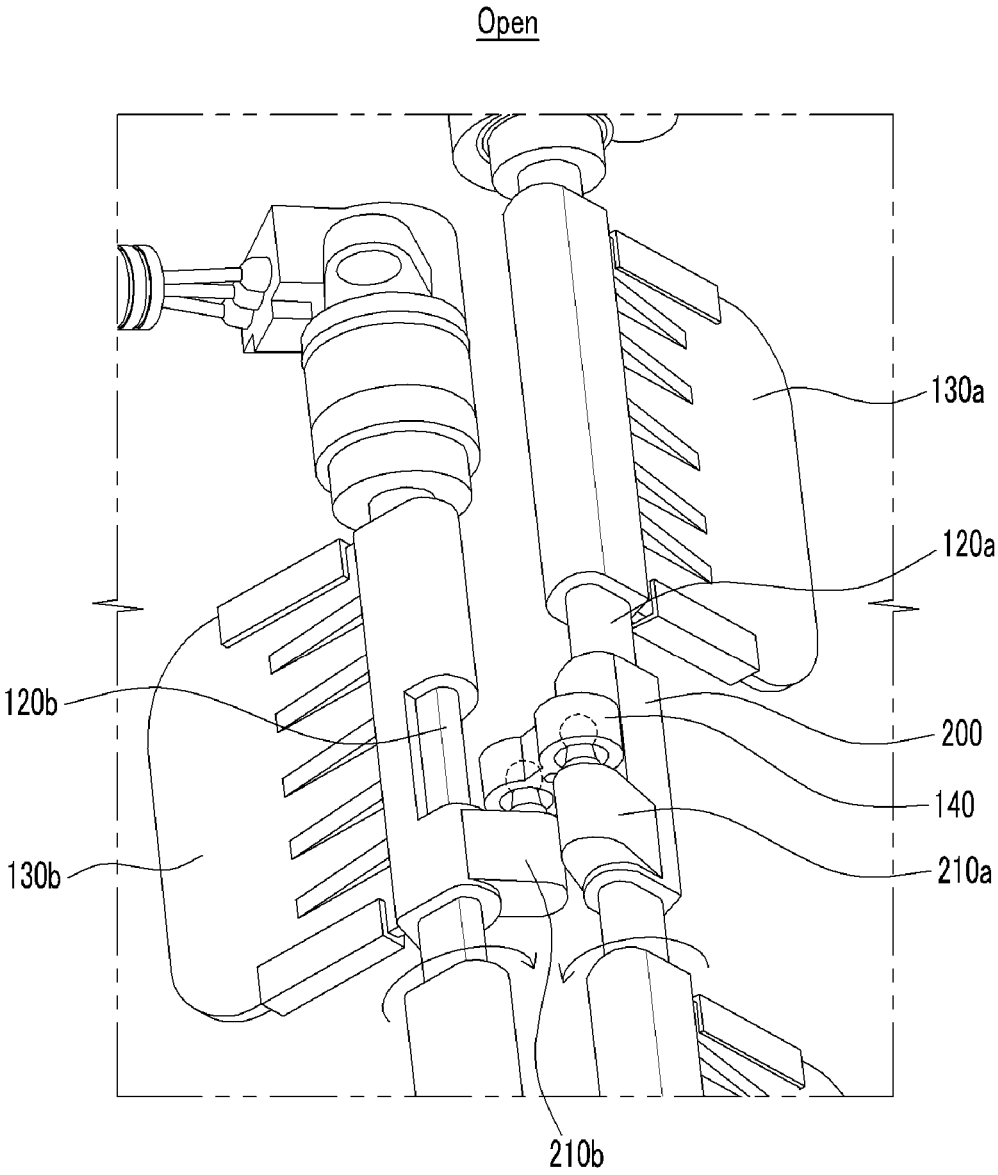
FIG. 4 is a perspective view showing an opened intake passage in an exemplary intake system of an engine according to the present invention.
Figure 5:
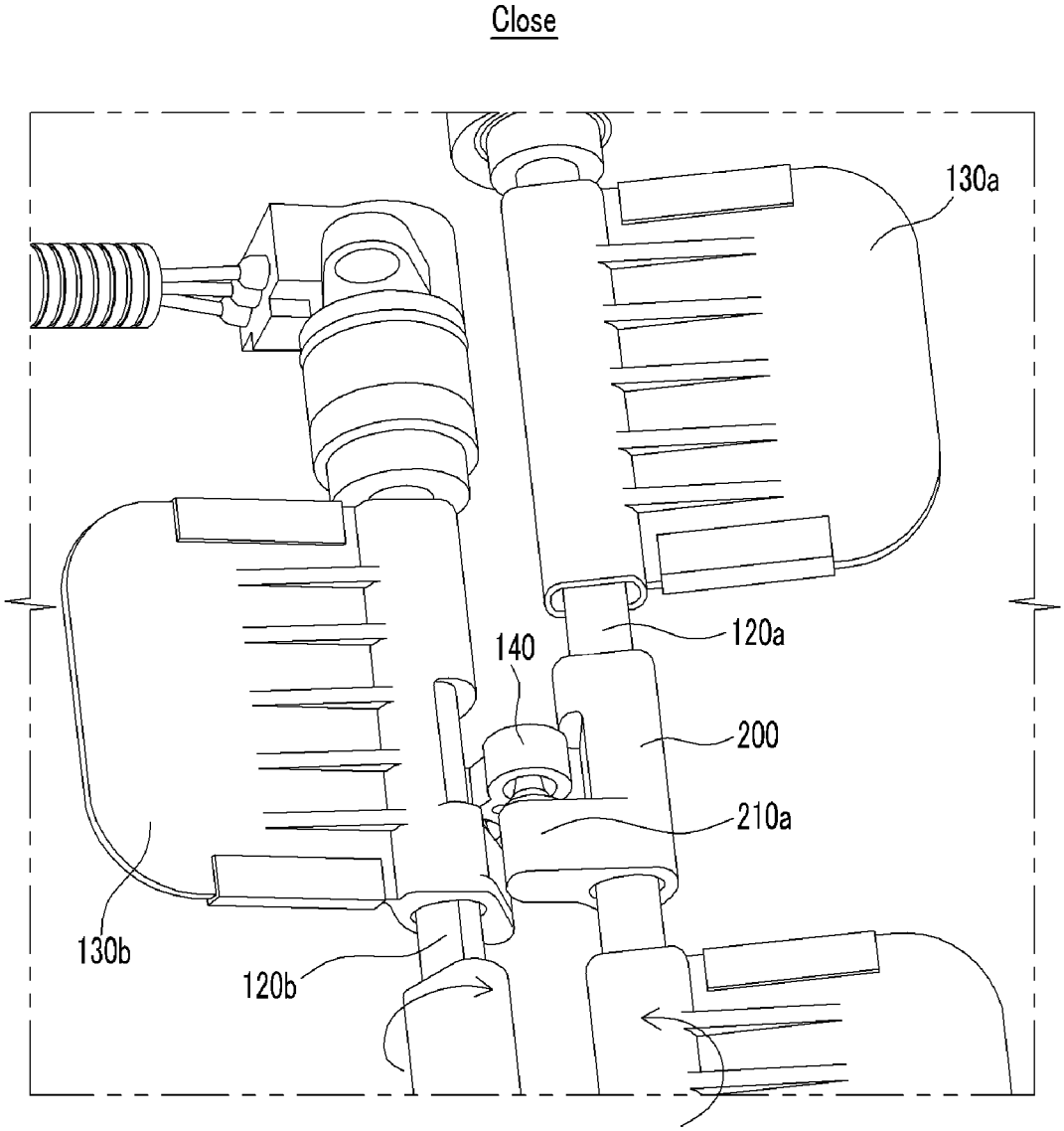
FIG. 5 is a perspective view showing a closed intake passage in an exemplary intake system of an engine according to the present invention.

FIG. 4 is a perspective view of an intake system of an engine in which an intake passage is opened according to an exemplary embodiment of the present invention, FIG. 5 is a perspective view of an intake system of an engine in which an intake passage is closed in according to an exemplary embodiment of the present invention, and FIG. 6 is a top plan view of an intake system of an engine in which an intake passage is closed in according to an exemplary embodiment of the present invention.

Referring to FIG. 4, the control portion operates the driving portion 100 according to a first driving condition of an engine to rotate the first shaft 120*a* to a first position and to rotate the second shaft 120*b* to a first position through the inter-lever 140, such that the first flap 130*a* and the second flap 130*b* open the intake passages.

Referring to FIG. 5 and FIG. 6, the control portion operates the driving portion 100 according to a second driving condition of an engine to rotate the first shaft 120*a* to a second position and to rotate the second shaft 120*b* to a second position through the inter-lever 140, such that the first flap 130*a* and the second flap 130*b* close the intake passages.

As described above, the opening rate of the first intake passage 600*a* and the second intake passage 600*b* is controlled by the first flap 130*a* and the second flap 130*b* according to the driving condition of the engine, and the tumble of air or air/fuel mixture supplied into the cylinder passing the intake passage is controlled such that the combustion efficiency thereof is improved.

In addition, more secure combustion can be achieved by controlling the air or the air/fuel mixture supplied into the cylinder depending on the driving condition of the engine.

In an engine having a first bank and a second bank such as a V6, a V8, and a V12 according to an exemplary embodiment of the present invention, the first intake passage 600*a* can be formed along the first bank and the second intake passage 600*b* can be formed along the second bank.

For convenience in explanation and accurate definition in the appended claims, the term "outer" is used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An intake system of an engine, comprising:

first intake passages and second intake passages that are collaterally disposed to the engine;

a first shaft and a second shaft that are collaterally disposed along the first intake passages and the second intake passages respectively;

first flaps and second flaps that are mounted on the first shaft and the second shaft so as to open or close the first intake passages and the second intake passages respectively;

an inter-lever, of which a first end portion is pivotally and eccentrically connected to the first shaft and a second end portion is pivotally and eccentrically connected to the second shaft, and through which a rotation of the first shaft is transferred to the second shaft; and a driving portion connected to the first shaft and rotating the first shaft to have the first flaps and the second flaps open or close the first intake passages and the second intake passages respectively, wherein the first end portion of the inter-lever is pivotally and eccentrically connected to a portion of the first shaft between the first flaps and the second end portion of the inter-lever is pivotally and eccentrically connected to one of the second flaps.

2. The intake system of claim 1, wherein the driving portion includes:

a first connecting lever, a first end portion of which is connected to a first end portion of the first shaft, and the other a second end portion of which extends in a radial direction of the first shaft;

an outer lever, a first end portion of which is pivotally connected to the second end portion of the first connecting lever;

a second connecting lever, a first end portion of which is pivotally connected to a second end portion of the outer lever; and a motor coupled to a second end portion of the second connecting lever and moving the second connecting lever to rotate the first shaft in a predetermined angle.

3. The intake system of claim 1, wherein the second intake passages are disposed at positions between the first intake passages such that the first intake passages and the second intake passages are alternately disposed.

4. The intake system of claim 1, wherein a bracket is coupled to the first shaft between the first flaps, a first protrusion is formed on the bracket, and a first ball joint is formed at one side surface of the first protrusion.

5. The intake system of claim 4, wherein the first protrusion is formed at an opposite side of the first flap across the first shaft and extends in a predetermined length in a radial direction of the first shaft.

6. The intake system of claim 5, wherein the first ball joint is formed to extend from the first protrusion along a longitudinal axis of the first shaft.

7. The intake system of claim 4, wherein a first insertion hole, through which the first ball joint is inserted, is formed at the one end portion of the inter-lever.

8. The intake system of claim 4, wherein a second protrusion is formed at the one of the second flaps in accordance with the first protrusion and a second ball joint is formed at one end portion of the second protrusion in accordance with the first ball joint.

9. The intake system of claim 8, wherein the second flap includes a receiving cut portion to receive the other end portion of the inter lever therein.

10. The intake system of claim 8, wherein the second protrusion is formed at an opposite side of the second flap across the second shaft and extends in a predetermined length in a radial direction from the second shaft.

11. The intake system of claim 10, wherein the second ball joint is formed to extend from the second protrusion along a longitudinal axis of the second shaft.

12. The intake system of claim 8, wherein a second insertion hole, through which the second ball joint is inserted, is formed at the other end portion of the inter-lever.

* * * * *